US006766031B1

(12) United States Patent
Westermann

(10) Patent No.: US 6,766,031 B1
(45) Date of Patent: Jul. 20, 2004

(54) IN-THE-EAR HEARING AID WITH REDUCED OCCLUSION EFFECT AND A METHOD FOR THE PRODUCTION AND USER-FITTING OF SUCH A HEARING AID

(75) Inventor: Soren Erik Westermann, Grønholt (DK)

(73) Assignee: Widex A/S, Vaerloese (DK)

( * ) Notice: Subject to any disclaimer, the term of this patent is extended or adjusted under 35 U.S.C. 154(b) by 0 days.

(21) Appl. No.: 09/403,203

(22) PCT Filed: Apr. 8, 1998

(86) PCT No.: PCT/DK98/00147

§ 371 (c)(1),
(2), (4) Date: Feb. 11, 2000

(87) PCT Pub. No.: WO98/47318

PCT Pub. Date: Oct. 22, 1998

(30) Foreign Application Priority Data

Apr. 15, 1997 (DK) ..... 0422/97

(51) Int. Cl.[7] ..... H04R 25/00

(52) U.S. Cl. ..... 381/328; 381/322

(58) Field of Search ..... 381/312, 328, 381/322, 324, 382; 189/129, 130, 135

(56) References Cited

U.S. PATENT DOCUMENTS 3,470,328 A * 9/1969 Daniels ..... 381/322
5,033,090 A 7/1991 Weinrich
5,195,139 A * 3/1993 Gauthier

FOREIGN PATENT DOCUMENTS

CH 681125 1/1993
DE 4008982 A1 9/1991
WO 91/03139 3/1991

OTHER PUBLICATIONS

Gail I. Gudmunsen, MA ("Physical Options", Dept. of Veteran Affairs: Rehabilitation Research and Development: Practical Hearing Aid Selection and Fitting, Jan. 1999, Chap. 1 pp. 1–17.*
Macrae, J., "A new kind of earmold vent—the high–cut cavity vent," "*Hearing Instruments,*" V32, N10, 1981, pp. 18, 84.
Macrae, J., "An Improved Version of The High–Cut Cavity Vent," "*Australian Journal of Audiology,*" 1981, 3:2, pp. 36–39.
Macrae, J., "A Damped High–Cut Cavity Vent For Profound Hearing Loss," "*Australian Journal of Audiology,*" 1982, 4:1, pp. 22–25.
Macrae, J., "Venting without feedback—further development of the high–cut cavity vent," "*Hearing Instruments,*" V33, N4, 1982, pp. 12–13, 42.
Macrae, J., "Vents for High–powered Hearing Aids," "*The Hearing Journal,*" Jan. 1983, pp. 13–16.
"Measuring Sound For Hearing Aid Evaluations," p. 111.

* cited by examiner

*Primary Examiner*—Curtis Kuntz
*Assistant Examiner*—P. Dabney
(74) *Attorney, Agent, or Firm*—Sughrue Mion, PLLC

(57) ABSTRACT

An in-the-ear hearing aid comprises a plug (1) for arrangement in the ear channel and having a shell-like wall facing the interior of the ear channel and an exterior faceplate (2) which together define a generally closed cavity (3), in which the individual components of the hearing aid are arranged. An acoustical link in the form of a hose or tube piece (13) is provided between an orifice (14) at the external side of the part of the wall of the plug (1) facing the interior of the ear channel and the residual volume (12) of the internal cavity of the plug (1) and forms together with said residual volume (12) an approximated acoustical circuit having a resonance frequency in the region of the first voice sound formants of the user. Thereby a significantly reduces occlusion effect can be obtained in a simple way in a completed hearing aid.

17 Claims, 1 Drawing Sheet

IN-THE-EAR HEARING AID WITH REDUCED OCCLUSION EFFECT AND A METHOD FOR THE PRODUCTION AND USER-FITTING OF SUCH A HEARING AID

BACKGROUND OF THE INVENTION

The present invention relates to a hearing aid for arrangement in the ear, particularly completely inside the ear canal, comprising a plug for arrangement in the ear canal and having a shell-like wall facing the interior of the ear canal and an outward faceplate which together define a generally closed cavity in which are arranged an input transducer, such as a microphone, for transforming external sounds into an electrical signal, a signal processor for processing the signal produced by the input transducer and producing a hearing-loss compensating electrical signal, and an output transducer for transforming the signal from the signal processor into a hearing-loss compensating sound signal, as well as a power source, such as a battery.

In hearing aids of this type, so-called occlusion effects often occur during use as a consequence of the closure of the ear canal caused by the hearing aid, which occlusion effects manifest themselves by the user experiencing his or her voice as dominant, because voice sounds are transmitted through bones and tissue to the residual volume which is located innermost in the ear canal and is defined by the housing of the hearing aid and the eardrum. Furthermore, changes in the differential pressure between the air in this confined volume and the atmosphere, for example when the user is inside an ascending airplane, may give rise to an unpleasant feeling, which can usually, however, be counteracted by the user making jaw movements that propagate to the ear canal and create pressure-equalizing leakages between the ear canal wall and the hearing aid.

To solve this problem it is well-known to provide both hearing aids of the type stated and ear plugs for conventional behind-the-ear hearing aids with a through-going vent passage from the innermost end of the hearing aid or the ear plug to the surroundings. Typically, such a vent passage or vent is formed as a hose or a tube extending through the hearing aid plug. However, this measure is disadvantageous in that it often gives rise to acoustical feedback because part of the sound amplified by the hearing aid and produced in the ear canal reaches the microphone of the hearing aid.

Some ear plugs without an integral hearing aid have a cavity in the vent passage to remedy this problem. The purpose of this design is to make the vent passage with such intermediate cavity act like a low-pass filter to damp the passage of high-frequency sounds and thus reduce the tendency of acoustical feedback.

Solutions of this type are described, i.a., in the following articles by John Macrae:

- "A new kind of earmold vent the high-cut cavity vent", Hearing Instruments, vol. 32, No. 10, 1981, page 18 pp.,
- "An improved version of the high-cut cavity vent", Australian Journal of Audiology, 1981 3:2, pages 36–39,
- "Venting without feedback—further development of the high-cut cavity vent", Hearing Instruments, vol. 33, No. 4, 1982, page 12 pp., and
- "A damped high-cut cavity vent for profound hearing loss", Australian Journal of Audiology, 1982 4:1, pages 22–25.

The vent systems discussed here for ear plugs function as ordinary vent passages as well as acoustic low-pass filters.

For hearing aids of the type indicated above of the ITE design, corresponding vent systems are known from, i.a., CH-A-681,125, the cavity coupled in here being constituted by the part of the cavity in the hearing aid housing not taken up by electronic components.

U.S. Pat. No. 5,195,139 further describes a hearing aid in which, from a conventional vent passage formed by a longitudinal canal through the wall or shell of the hearing aid plug, an opening has been established into a closed cavity in the hearing aid. The system functions as a Helmholtz resonator, whereby transmission of undesired frequencies through the vent passage is damped. This is high-frequency damping in the range from 2.0 to 6.5 kHz. In addition to this filter characteristic, the vent passage functions as an ordinary vent passage.

SUMMARY OF THE INVENTION

Accordingly, it is an object of the invention to provide a hearing aid of the type stated, in which a significant damping of occlusion effects can be obtained without the use of a conventional vent passage or vent with the consequent problems in the form of manufacturing and mounting complications, acoustical feedback, etc.

For a hearing aid of the type stated, this is obtained according to the invention in that an acoustical link in the form of a hose or tube piece is provided between an orifice at the external side of the part of the wall of the plug facing the interior of the ear canal and the residual volume of the internal cavity of the plug and, together with said residual volume in the cavity, forms an approximated acoustical circuit having a resonance frequency in the region of the first voice sound formants of the user.

By means of the invention, undesired occlusion effects are damped through the increase of the residual volume constituted by the part of the cavity in the hearing aid housing which is not taken up by the electronic components of the hearing aid and produced by said acoustical link in the interior of the ear canal within the hearing aid, and this increase of volume is made virtually larger at the resonance frequency of the acoustical circuit. Through the increase of the residual volume, the sound pressure of occlusion sounds is reduced, since the surfaces that transmit the occlusion sounds are not changed. Thereby the invention can damp occlusion sounds both with and without a through-going vent passage, as explained in detail below.

Formation of said approximated acoustical circuit having a resonance frequency in the region of the first voice sound formants of the user, typically in the region from about 200 to about 800 Hz, causes a damping of the otherwise bothering propagation of the user's voice sounds.

According to one embodiment of the invention, a certain softening of this damping may be obtained, if desired, by a through-going vent passage or vent being provided as well from said residual volume in the ear canal to the surroundings.

The invention also relates to a method for the production and user-fitting of a hearing aid of the type stated, whereby a plug formed for arrangement in the ear canal is manufactured with a substantially closed shell-like wall facing the interior of the ear canal and an outward faceplate which together define a generally closed cavity in which are arranged an input transducer, such as a microphone for transforming external sound into an electrical signal, a signal processor for processing the signal produced by the input transducer and producing a hearing-loss compensating electrical signal, and an output transducer for transforming the signal from the signal processor into a hearing-loss compensating sound signal, as well as a power source, such as a battery.

According to the invention, this method is characterized in that an acoustical link in the form of a hose or tube pice is provided between an orifice at the external side of the part of the wall of the plug facing the interior of the ear canal and the residual volume of the internal cavity of the plug, which hose or tube piece is tuned so that together with said residual volume in the cavity it forms an approximated acoustical circuit having a resonance frequency in the region of the first voice sound formants of the user.

Thereby the occlusion-effect-reducing acoustical link can be provided in a simple manner in a completed hearing aid.

BRIEF DESCRIPTION OF THE DRAWINGS

Advantageous embodiments and features of the hearing aid and the method according to the invention are indicated in the dependent claims 2–7 and 9–14.

The invention will now be explained in more detail below with reference to the schematic drawing, in which.

DETAILED DESCRIPTION OF THE INVENTION

Figure 1:
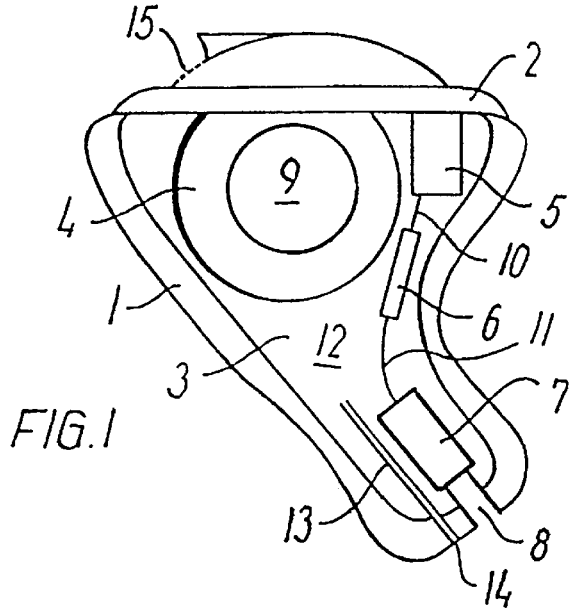
FIG. 1 shows an embodiment of a hearing aid according to the invention in a CIC design, and FIG. 2 provides graphical reproductions of the sound pressure in a residual volume in the ear canal, partly for a conventional, unvented CIC hearing aid, partly for the hearing aid according to the invention with reduced occlusion effect without and with a through-going vent passage.

The hearing aid shown in FIG. 1 in a so-called CIC design, i.e., for arrangement completely inside the ear canal, comprises a preferably individually adapted plug 1 with a shell-like wall defining an outward orifice, at which a faceplate 2 is fastened to the plug 1, for example by gluing.

When such hearing aid is arranged in the ear canal, a residual volume is left between the tapering end of the plug 1 facing the interior of the ear canal and the eardrum, often giving rise to unpleasant occlusion effects manifesting themselves in an amplification of the user's own voice, especially in the region of the first voice sound formant, because of sound transmission to the residual volume through bones and tissue.

In the hearing aid of FIG. 1, which may suitably be constructed in a compact, modular design as described in the Applicant's concurrent DK patent application No. 0422/97, but is not limiter thereto, the wall of the plug 1 and the faceplate 2 together define a cavity 3 in which, during use of the hearing aid, are arranged a battery 4, a microphone part 5, a signal processing part 6 with the amplifier circuit of the hearing aid, and a sound reproducer in the form of a receiver 7, from which the sound is transmitted to the residual volume of the ear canal through a sound exit orifice 8. Said components in the hearing aid are supplied with electric power from terminals 9 on the battery 4 and are in general interconnected via wire connections 10 and 11.

Although said components take up some space in the cavity 3, it will always have a free residual volume 12.

According to the invention, the above residual volume in the ear canal is connected with this residual volume through an acoustical link in the form of a hose or tube piece 13, which is connected to an orifice 14 at the external side of the part of the shell-like wall of the plug 1 facing the interior of the ear canal.

Together with the residual volume 12 in the plug 1, this hose or tube piece 13 forms an approximated acoustical circuit having a resonance frequency in the region of the first voice sound formants of the user.

Theoretically and ideally, the tuned acoustical circuit acts as an approximated Helmholtz resonator according to the formula $$\omega_0 = c*(A/(L*V))^{0.5},$$

where $\omega_0$ is the angular frequency c is the velocity of sound in air, about 340 m/s, A is the internal cross-sectional area of the hose or tube piece 13 in $m^2$, L is the length of the hose or tube piece 13 in m, and V is the volume of the cavity 3 in $m^3$, resulting in the resonance frequency $$F_0 = \omega_0/(2*\pi)$$

This is a theoretically ideal formula. In practice, the values stated are tuned with empirically found correction factors. Thus, to the length L of the hose or tube piece 13, a correction factor depending on its internal diameter often has to be added and multiplied by a correction factor depending on the hose or tube material.

Arrangement of this resonance frequency in the frequency region where the user's voice penetrates strongly to the residual volume in the ear canal provides a substantial damping of occlusion effects and an improvement of the comfort of use and speech reproduction during conversation through a damping of the user's own voice.

This frequency region is typically in a range between 50 and 1000 Hz. For men, it is typically between 200 and 800 Hz, while for women it is typically between 250 and 900 Hz.

At a dimensioning suitable for this, the cavity 3 in the plug 1 may thus have a volume V of 0.3–1.2 $cm^3$, especially 0.6 $cm^3$, while the hose or tube piece 13 may have an internal diameter of 0.5–2.0 mm, especially 1 mm, and a length L of 3–20 mm, especially 7 mm.

The acoustical link through the hose or tube piece 13 is preferably provided in a completed hearing aid by drilling a hole corresponding to the orifice 14, whereupon the hose or tube piece 13 is inserted into the plug 1 at an insertion length corresponding to the calculated value and is fastened to the plug 1 by gluing or melting.

In the graphical illustration in FIG. 2, the effect of providing the acoustical link according to the invention is illustrated by the fully drawn graph B, which, compared with the dashed graph A for a conventional non-vented CIC hearing aid, shows a significant resonance damping of about 15 dB around 700 Hz, whereas the damping some octaves below the resonance frequency only amounts to a value corresponding to the real volume increase from the cavity 3.

Figure 2:
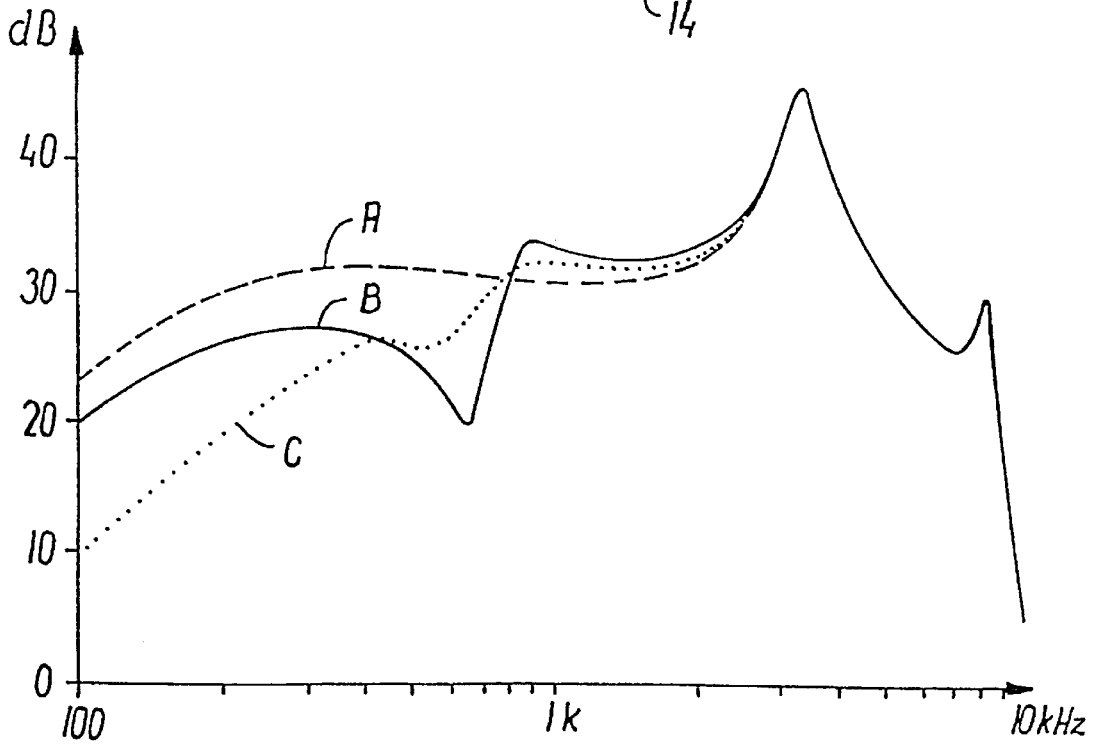

The graphs in FIG. 2 show the amplification in dB in relation to the frequency in Hz recorded in an acoustical coupler system pursuant to IEC 711 for a cavity 3 in the plug 1 having a volume of 0.6 $cm^3$ and a hose or tube piece 13 having an internal diameter of 1 mm and a length of 7 mm.

In practice, it will be desirable with a softening of the resonance damping in many cases. Such softening can be obtained according to one embodiment of the invention, by supplementing the system with a leak in the form of a through-going vent passage or vent from the residual volume in the ear canal to the surroundings.

As shown in FIG. 1, such vent passage can be established in a simple manner by drilling one or more pinholes 15 in the outward side of the hearing aid, for example in the battery lid 16. The aggregate vent passage will here extend from the orifice 14 through the hose or tube piece 13 and the cavity 3 to the pinhole or pinholes 15.

This measure typically provides a damping function as illustrated by the dotted graph C in FIG. 2.

As another possibility, a through-going vent passage may be formed as a separate passage through the hearing aid, for example in the shell-like wall of the plug 1, such as is described in WO 91/03139, whereby the acoustical link according to the invention is not part of the vent passage, but can be freely dimensioned to provide the optimum damping of occlusion effects.

In many cases there will already be leaks between the plug 1 and the wall of the ear canal in themselves forming a vent passage. In such cases, the acoustical link can also have the optimum design concerning damping of occlusion effects.

It is an advantage of the invention that it does not require special preparation of the hearing aid before provision of the acoustical link.

A first work step in an otherwise completed hearing aid may therefore be to decide whether an acoustical link should be provided.

To determine whether an acoustical linking the plug 1 is needed, a tightness/acoustical measurement with the plug 1 arranged in the ear canal may be performed according to the method of the invention prior to provision of the-acoustical link.

What is claimed is:

1. A hearing aid for arrangement in the ear, comprising a plug for arrangement in the ear canal, said plug having a shell-like wall for facing the interior of the ear canal with an orifice at a part of said wall adapted for facing the ear canal, and a faceplate fastened to said wall, said wall and said faceplate together defining a hearing aid with a generally closed cavity, an input transducer for transforming external sounds into an electrical signal, a signal processor for processing the signal produced by the input transducer for producing a hearing-loss compensating electrical signal, an output transducer for transforming the signal from the signal processor into a hearing-loss compensating sound signal, a power source, and a tube piece provided between said orifice and said cavity, wherein said input transducer, said signal processor, said output transducer and said power source are arranged inside said cavity so as to occupy part of said cavity while leaving a cavity residual volume, and wherein said cavity and tube piece are tuned to provide an acoustical circuit having a resonance frequency in the region of the first voice sound formants of the user.

2. The hearing aid according to claim 1, wherein said cavity and tube piece are tuned to provide a resonance frequency in the range between 50 and 1000 Hz.

3. The hearing aid according to claim 1, wherein said cavity and tube piece are tuned to provide a resonance frequency in the range between 200 and 800 Hz.

4. The hearing aid according to claim 3, wherein said cavity has a volume of 0.6 $cm^3$, while said tube piece has an internal diameter of 1 mm, and a length of 7 mm.

5. The hearing aid according to claim 1, wherein said cavity residual volume is in the range of 0.3–1.2 $cm^3$, and wherein said tube piece has an internal diameter of 0.5–2.0 mm, and a length of 3–20 mm.

6. The hearing aid according to claim 1, comprising a vent passage from said cavity to the surroundings.

7. The hearing aid according to claim 6, wherein said vent passage comprises one or more pinholes in a part of said hearing aid housing facing the surroundings.

8. A method for the production of a hearing aid comprising providing a plug for arrangement in the ear canal, said plug having a shell-like wall for facing the interior of the ear canal a faceplate, an input transducer for transforming external sounds into an electrical signal, a signal processor for processing the signal produced by the input transducer for producing a hearing-loss compensating electrical signal, an output transducer for transforming the signal from the signal processor into a hearing-loss compensating sound signal, a power source, and a tube piece, fastening said faceplate to said wall in order that said wall and said faceplate together define a hearing aid housing with a generally closed cavity, arranging said input transducer, said signal processor, said output transducer and said power source inside said cavity so as to occupy part of said cavity while leaving a cavity residual volume, providing an orifice in a part of said wall adapted for facing a residual volume of the ear canal, arranging said tube piece between said orifice and said cavity, and tuning said cavity and said tube piece in order that said tube piece together with said cavity residual volume provide an acoustical circuit having a resonance frequency in the region of the first voice sound formants of the user.

9. The method according to claim 8, wherein said resonance frequency is in the range between 50 and 1000 Hz.

10. The method according to claim 8, wherein said resonance frequency is in the range between 200 and 800 Hz.

11. The method according to claim 8, wherein said tube piece has an internal diameter of 0.5–2.0 mm, while said cavity has a volume of 0.3–1.2 $cm^3$.

12. The method according to claim 8, wherein the step of tuning said cavity and said tube piece comprises inserting said tube piece into said cavity at an insertion length suitable to achieve a calculated value.

13. A method according to claim 8, comprising providing a vent passage in a part of said hearing aid facing the surroundings.

14. The method according to claim 8, wherein said cavity has a volume of 0.6 cm3, while said tube piece has an internal diameter of 1 mm, and a length of 7 mm.

15. A hearing aid for arrangement in the ear, comprising a plug for arrangement in the ear canal, said plug having a shell-like wall for facing the interior of the ear canal with an orifice at a part of said wall adapted for facing a residual volume of the ear canal, and a faceplate fastened to said wall, said wall and said faceplate defining together a hearing aid housing with a generally closed cavity, an input transducer for transforming external sounds into an electrical signal, a signal processor for processing the signal produced by the input transducer for producing a hearing-loss compensating electrical signal, an output transducer for transforming the signal from the signal processor into a hearing-loss compensating sound signal, a power source, and a tube piece provided between said orifice and said cavity, wherein said input transducer, said signal processor, said output transducer and said power source are arranged inside said cavity so as to occupy part of said cavity while leaving a cavity residual volume, and wherein said cavity and said tube piece are tuned to provide an acoustical circuit having a resonance frequency in the range between 50 and 1000 Hz.

16. A method for the manufacturing of a hearing aid, comprising providing a plug for arrangement in the ear canal, said plug having a shell-like wall for facing the interior of the ear canal, a faceplate, an input transducer for transforming external sounds into an electrical signal, a signal processor for processing the signal produced by the input transducer for producing a hearing-loss compensating electrical signal, an output transducer for transforming the signal from the signal processor into a hearing-loss compensating sound signal, a power source, and a tube piece, fastening said faceplate to said wall in order that said wall and said faceplate together define a hearing aid housing with a generally closed cavity, arranging said input transducer, said signal processor, said output transducer and said power source inside said cavity so as to occupy part of said cavity while leaving a cavity residual volume, providing an orifice in a part of said wall adapted for facing a residual volume of the ear canal, arranging said tube piece between said orifice and said cavity, and tuning said cavity and said tube piece in order that said tube piece together with said cavity residual volume provide an acoustical circuit having a resonance frequency in the range between 50 and 1000 Hz.

17. A method for the manufacturing of a hearing aid, comprising the steps of:

providing a plug for arrangement in the ear canal, said plug having a shell-like wall for facing the interior of the ear canal, a faceplate, an input transducer for forming external sounds into an electrical signal, a signal processor for processing the signal produced by the input transducer for producing a hearing-loss compensating electrical signal, an output transducer for transforming the signal from the signal processor into a hearing-loss compensating sound signal, and a power source, fastening said faceplate to said wall in order that said wall and said faceplate together define a hearing aid housing with a generally closed cavity, arranging said input transducer, said signal processor, said output transducer and said power source inside said cavity so as to occupy part of said cavity while leaving a cavity residual volume, providing a hole in a part of said wall adapted for facing a residual volume of the ear canal, providing a tube piece adapted for achieving together with said cavity residual volume an acoustical circuit having a resonance frequency in the range between 50 and 1000 Hz, inserting said tube piece in said hole, and fastening said tube piece to said plug.

* * * * *